US006003865A

United States Patent [19]

Hayashi

[11] Patent Number: 6,003,865

[45] **Date of Patent: *Dec. 21, 1999**

[54] SHEET PROCESSING APPARATUS

[75] Inventor: Kenichi Hayashi, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/578,340

[22] Filed: Dec. 26, 1995

[30] Foreign Application Priority Data

Dec. 26, 1994 [JP] Japan ..... 6-323274
Sep. 26, 1995 [JP] Japan ..... 7-248002

[51] Int. Cl.[6] ..... B65H 39/10

[52] U.S. Cl. ..... 271/287; 271/207; 271/292

[58] Field of Search ..... 312/310, 311; 355/323; 271/3.14, 4.01, 162, 207, 273, 287, 292; 399/124, 125

[56] References Cited

U.S. PATENT DOCUMENTS 3,411,771 11/1968 Bahr et al. ..... 271/273
4,640,604 2/1987 Kozuka et al. ..... 399/124
4,734,748 3/1988 Murayama et al. ..... 271/287
4,814,817 3/1989 Nishijima et al. ..... 399/125
5,050,860 9/1991 Matsuo et al. ..... 271/293

FOREIGN PATENT DOCUMENTS 0191374 8/1987 Japan ..... 271/287
0203168 8/1989 Japan ..... 271/287

OTHER PUBLICATIONS

Korean Patent Office Official Action mailed Feb. 27, 1999. (with English language statement of rejection).

*Primary Examiner*—H. Grant Skaggs
*Attorney, Agent, or Firm*—Fitzpatrick, Cella, Harper & Scinto

[57] ABSTRACT

A sheet processing apparatus includes a main assembly having an upper frame and a lower frame, the upper frame being rotatably openable with respect to the lower frame; a sheet accommodating device having at least one sheet receiving tray for receiving a sheet discharged from the main assembly, the sheet accommodating device being movable between an operative position for accommodating the sheet and a retracted position away from the main assembly; and a connector for connecting the sheet accommodating means to the main assembly, the connector being effective to keep the sheet accommodating device away from the main assembly when the upper frame is being closed.

22 Claims, 6 Drawing Sheets

SHEET PROCESSING APPARATUS

FIELD OF THE INVENTION AND RELATED ART

The present invention relates to a sheet processing apparatus comprising connecting means. More specifically, it relates to the connecting apparatus of a sheet processing apparatus (system) comprising a sheet storage apparatus (sorter, finisher, and the like) for sequentially sorting and storing the sheets, which are discharged from an image forming apparatus such as a copying machine, a printer, and the like after image formation, into plural sheet receiver plates (hereinafter, bin trays), wherein the connecting apparatus connects the image forming apparatus to the sheet storage apparatus.

Some of the conventional low to medium speed image forming apparatuses are widely known as the alligator jaw type. This is because their main assembly frames are constituted of a top portion and a bottom portion, and when an operational problem, such as a jam occurs, it is dealt with by swinging open the top portion of the main assembly frame. In the case of the alligator type image forming apparatus, its long sheet path can be exposed by a single action, that is, by simply releasing the top portion of the main assembly frame; therefore, the alligator type apparatus has an advantage in that a jam (paper jam) can be easily dealt with.

In recent years, the demand for equipping even the low to medium speed apparatuses with a sheet storage apparatus capable of collating and stacking, as well as stapling and performing like operations as needed, has been increasing.

FIG. 10 is a front view of a sheet processing apparatus with a sorter, wherein the sheet processing apparatus is connected to an alligator jaw type image forming apparatus. The main assembly of an image forming apparatus 100 comprises a top frame 101 which can be rotatably opened about an axis 103, and a bottom frame 102 which remains stationary.

A reference numeral 200 designates a sorter with a bin B. The bin B is tilted so that its downstream side, relative to the sheet conveyance direction, is rendered higher than the upstream side. A reference numeral 300 designates a connecting apparatus for connecting the aforementioned bottom frame 102 and sorter 200. The top surface of the image forming apparatus 100 and that of the sorter 200 are set substantially at the same level, so that the sorter 200 appears to be an integral part of the entire system.

In the case of the conventional apparatus, as the top frame 101, which is open, being thereby positioned as illustrated by the two-dot chain line, is closed after the jam or the like is dealt with, the gap between the image forming apparatus 100 and sorter 200 gradually narrows. Therefore, special attention must be paid to the gap, so that the top frame 101 can be safely returned to its closed position. As a result, operational efficiency is decreased. Thus, it is preferable, in terms of the operational properties of the top frame, that when the top frame is lowered from the open position to the closed position, the sorter remains at its retracting position, which is away from its operating position, so that there is always sufficient room available between the sorter and the top frame while the top frame is closed.

SUMMARY OF THE INVENTION

Accordingly, a primary object of the present invention is to improve the operational properties of a sheet processing apparatus comprising a connecting apparatus for connecting a sheet storage apparatus to the apparatus main assembly separable into a top frame and a bottom frame, in terms of closing the top frame from the open position to the closed position, and/or in terms of opening it from the closed position to the open position.

The present invention was made in view of the aforementioned concerns, and according to an aspect of the present invention, a sheet processing apparatus comprises: a main assembly separable into a vertically openable top frame, and a stationary bottom frame; a sheet storing means, which comprises a minimum of one sheet receiver plate capable of storing the sheet discharged from the main assembly of the image forming apparatus, and which is movable between an operating position, at which the sheet is stored, and a retracting position which is away from the main assembly; and a connecting means for connecting the sheet storing means to the main assembly; wherein the connecting means is capable of keeping the sheet storing means away from the main assembly during the operation for closing the top frame.

According to the other aspects of the present invention, the movement of the sheet storing means in the direction from the operating position to the retracting position is linked, by the connecting means, to the operation for opening the top frame.

Further, it is preferable that the connecting means comprise latching means, which is not engageable to lock the sheet storing means at the operating position when the top frame is open.

Further, the movement of the sheet storing means is preferably a pivoting movement about an axis.

Further, it is more preferable that the connecting means comprises: supporting means for supporting the sheet storing means in such a manner that the sheet storing means is allowed to pivot to, and away from, the apparatus main assembly; and engaging means which normally locks the sheet storing means to the apparatus main assembly, but unlocks it as the top frame is opened.

Further, the sheet storing means may be supported by the supporting means in such a manner that it pivots due to its own weight as its engagement to the apparatus main assembly is broken.

Further, the top frame pivots to, and away from, the bottom frame.

Further, the apparatus main assembly may be constituted of an image forming apparatus, and the sheet storing means may be constituted of a sorter.

Further, the sheet storing means which pivots about the support axis, is constituted by a sorter.

Further, the sorter comprises plural bin trays, which are vertically arranged, being tilted in such a manner that the downstream side relative to the sheet discharge direction becomes higher than the upstream side, and the pivoting angle of the sorter is preferably in a range in which the bin trays can remain tilted in the same direction, or at least substantially level, without being tilted in the opposite direction.

Further, the tilt angle of the sorter at the retracting position, relative to the vertical direction, may be set to be smaller than the tilt angle of the bin tray at the operating position of the sorter, relative to the horizontal direction.

Further, the movement of the sheet storing means is a sliding movement.

Further, the connecting means preferably comprises: supporting means for supporting the sheet storing means in such a manner that the sheet storing means is allowed to slide to, or away from, the apparatus main assembly; and engaging means which normally locks the sheet storing means to the apparatus main assembly, but releases it as the top frame is opened.

Further, the sheet storing means preferably remains under the influence of pressure generating means so that it slides away from the apparatus main assembly as its engagement to the apparatus main assembly is broken.

Further, the connecting means, which connects the sheet storing means to the apparatus main assembly, comprises: engaging means, which breaks the engagement of the sheet storing means to the apparatus main assembly as the top frame is opened; and supporting means, which supports the sheet storing means in such a manner that the sheet storing means can be moved to, or away from, the apparatus main assembly, and moves the sheet storing means in a direction away from the apparatus main assembly as the engagement is broken.

Further, the means for moving the sheet storing means in the direction away from the apparatus main assembly may be constituted by a spring.

As described above, according to the present invention, a sufficient space is secured between the apparatus main assembly and sheet storing apparatus; therefore, the operational properties of the top frame are improved, and subsequently, the operational properties of the apparatus main assembly in terms of dealing with a jam are improved.

In addition, when the means for moving the sheet storing apparatus to the retracting position is constituted by the operation for tilting the sheet storing apparatus, the tilt angle of the sheet storing apparatus at the retracting position is set to be smaller than, or substantially the same as, the tilt angle of the sheet receiver plate of the sheet storing apparatus at the operating position; therefore, even after the sheet storing apparatus is moved to the retracting position, the occurrence of a phenomenon that the sheets accumulated in the sheet receiver plate fall from the sheet receiver plate can be prevented.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Hereinafter, the first embodiment of the present invention will be described with reference to the drawings.

Figure 1:
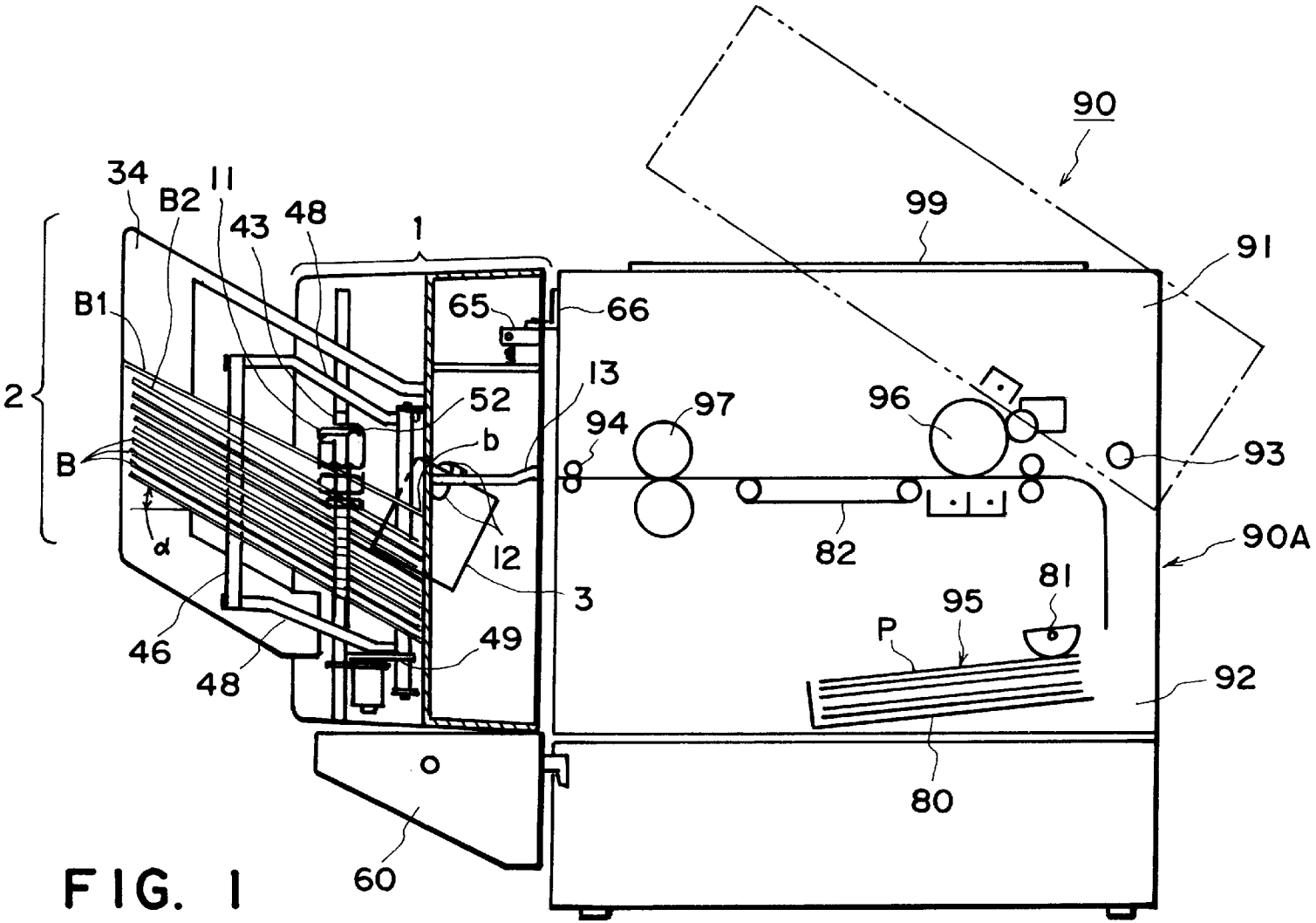
FIG. 1 is a vertical section of the sorter and image forming apparatus connected to each other by the connecting apparatus, in the first embodiment of the present invention.

FIG. 1 is a front view of a sheet processing apparatus in accordance with the present invention, comprising an image forming apparatus 90, a sorter (sheet storing apparatus) 1, and a connection apparatus 60.

The main assembly 90A of the image forming apparatus 90 comprises a bottom frame 92, and a top frame 91. The side edge of the top frame 91 is hinged to the corresponding side edge of the bottom frame 92, using an axis (hinging means). Therefore, the top frame 91 can be rotatably opened by an operator from the closed position, illustrated by a solid line, to the open position, illustrated by a chain line; it can be opened like an alligator jaw.

The image forming apparatus 90 comprises a photosensitive drum 96 (image forming section), on which an electrostatic latent image is formed in response to the image data obtained by scanning an original, which is placed on the platen of the apparatus main assembly 90A, using an unillustrated optical system. The electrostatic latent image formed on the photosensitive drum 96 is developed into a toner image using a well-known electrophotographic method.

A sheet feeder section comprises a cassette 80 for storing plural sheets P, a feeder roller 81, and the like. The sheet P fed in by the sheet feeder roller 81 is delivered to the photosensitive drum 9, from which the toner image is transferred onto the sheet P, as the sheet P is passing by. Then, the sheet P, now bearing the toner image, is delivered, by a delivery means, to a pair of fixing rollers 97, by which the toner image is fixed to the sheet P. After the toner image is fixed to the sheet P, the sheet P is delivered by a pair of sheet discharge rollers 94, to the sheet delivery path 13 of the sorter 1 connected to the image forming apparatus 90, as will be described later.

The sorter 1 is disposed on the downstream side of the image forming apparatus 90, relative to the direction of sheet discharge. It comprises a bin unit 2. The bin unit 2 comprises a pair of side plates 34, and plural bin trays B (sheet receiver trays) which receive and store the sheet P. These bin trays B are tilted at a predetermined angle (tilt angle: $\alpha$), with their downstream side, relative to the sheet discharge direction, being higher. Each bin tray B is provided with a bin stopper b (sheet stopper), which is attached to the bin tray B, on the upstream side edge, and comes in contact with the edge of the sheet P to stop it as it is discharged into the bin tray B and slides down on the bin bray B toward the upstream side.

A reference numerals 48 designate top and bottom arms, which support an aligning rod 46, and are pivotally anchored to an axis 49. A reference numeral 11 designates a rotary elevator. It is provided with a spiral guide groove 52, in which the bin roller (trunnion) of the bin tray B is fitted. As the rotary elevator is rotated, the bin rollers are guided by the spiral guide groove 52, whereby the bin unit 2 is vertically moved, and also, the space above each bin tray B is widened as the bin roller of the bin tray B immediately above is guided through the guide groove 52 of the rotary elevator 48. A reference numeral 13 designates a sheet delivery path which guides the sheet P discharged from the image forming apparatus 90 by the sheet discharge roller pair 94. A reference numeral 12 designates a sheet discharge roller pair, which discharges the sheet P delivered through the sheet delivery path 13, into each of the bin trays B1, B2, B3, and so on. A reference numeral 3 designates a stapler, which binds, as needed, the sheet set stored in each bin tray B.

Figure 2A:
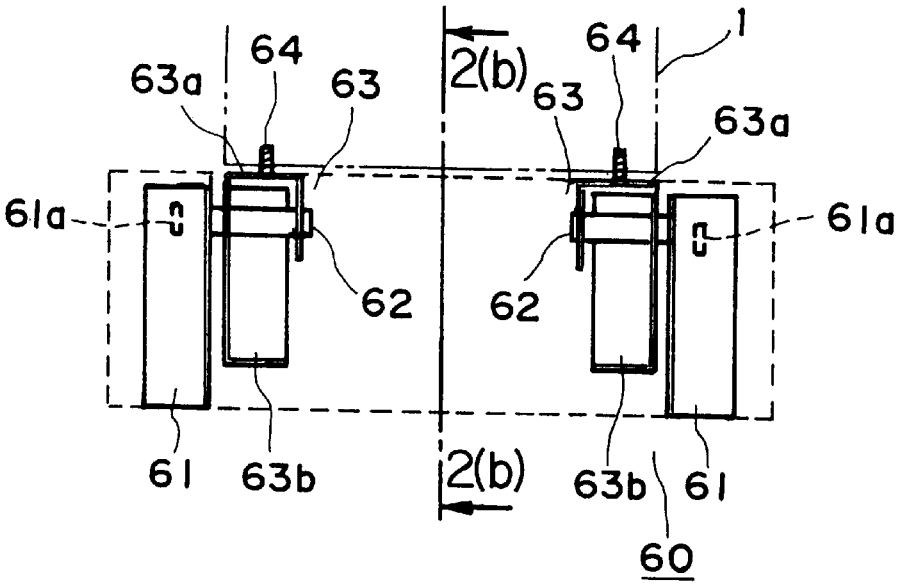
FIG. 2(*a*) and FIG. 2(*b*) are a plan view, and a sectional view, at a line C—C, respectively, of the connecting apparatus in the first embodiment of the present invention.
Figure 2B:
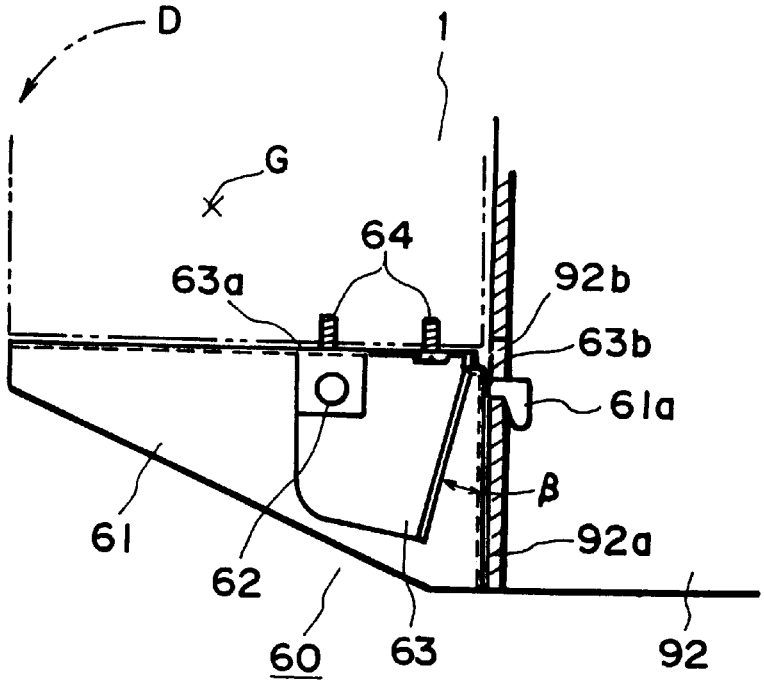

FIG. 2 depicts a connecting apparatus 90, which connects the sorter 1 to the image forming apparatus 90; FIGS. 2(*a*) and 2(*b*) are a left side view, and a sectional view, at the C—C line in FIG. 2(*a*), respectively, of the connecting apparatus 60 illustrated in FIG. 1.

The sheet processing system comprises two symmetrically located connecting apparatuses 60, one in front and the other in the rear (left and right sides in FIG. 2(*a*)). The connecting apparatus 60 connects the sorter 1 to the bottom frame 92 of the apparatus main assembly 90A. The front and rear connecting apparatuses are designated with the same reference numeral.

In FIG. 2, a mounting plate 61 has a positioning portion 61*a* with a projecting end. The mounting plate 61 is anchored to the bottom frame by hooking this positioning portion 61*a* into a mounting hole 92*b* cut through the bottom frame 92. A support axis 62 is fixed to substantially the middle portion of the mounting plate 61. A pivoting plate 63 is rotatably attached to the mounting plate 61 by putting the support axis 62 through the hole cut through the pivoting plate 63.

Referring to FIG. 2(*a*), the pivoting plate 63 is L-shaped, and the pivoting plate 63 is fixed, by its horizontal portion 63*a*, to the bottom surface of the sorter 1 using a small screw. Next, referring to FIG. 2(*b*), the horizontal portion (FIG. 2(*a*)) of the pivoting plate 63 is bent 90°, on the side of the apparatus main assembly 90A, to form the side wall portion 63*b*. When the sorter 1 is ready for operation (positioned as illustrated in FIG. 2(*b*)), this side wall portion 63*b* forms an angle of β (pivoting angle) relative to the apparatus main assembly 90A.

Figure 4:
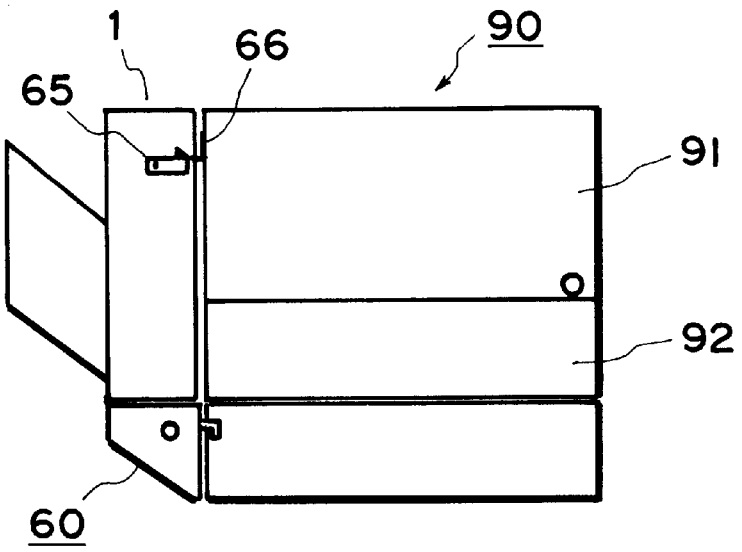
FIG. 4 depicts the top frame at the closed position, and the sorter at the operating position, in the first embodiment of the present invention.

When the sorter 1 is positioned as illustrated in FIGS. 1 and 4, the sorter 1 is allowed to receive, sort, and store the sheets P discharged from the image forming apparatus 90. The sorter 1 can be pivoted between this operating position, and the retracting position (FIG. 5) where the sorter is away from the image forming apparatus 90.

As the sorter 1 is pivoted away from the apparatus main assembly 90A, the side wall portion 63*b* of the pivoting plate 63 comes in contact with the side wall 92*a* of the bottom frame 92, regulating the pivoting movement of the sorter 1; in other words, the pivoting range of the sorter 1 is limited to the aforementioned angle β. The angle β is set up to be no more than the tilt angle α of the bin tray B (or β α). With this arrangement, even after the sorter 1 is pivoted to the retracting position, that is, even after it is tilted by the angle β, the bin tray B remains tilted, with its downstream side being still higher than the upstream side, or at least, the bin tray B remains substantially level; therefore, the sheet set stored in the bin tray B is prevented from sliding off the bin tray B, despite the tilting of the sorter 1.

Referring to FIG. 2(*b*), the support axis 62 is located on the right side (closer to the apparatus main assembly 90A), relative to the center of gravity G of the sorter 1; therefore, the sorter 1 is always subjected to a force acting to rotate the sorter 1, along with the pivoting plate, about the support axis 62 in the direction of an arrow mark D. When the sorter 1 is at the operating position, it is locked to the apparatus main assembly 90A by a latch mechanism located between itself and the top frame 91, so that it is prevented from pivoting to the retracting position due to its own weight.

Figure 3A:
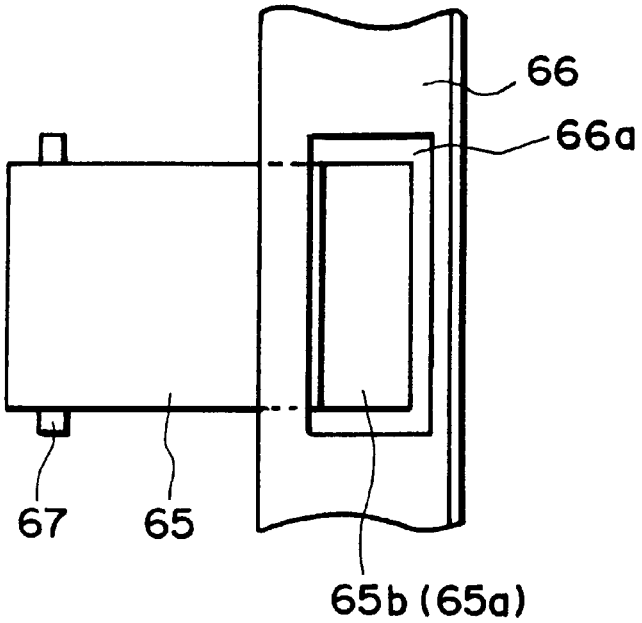
FIG. 3(*a*) and FIG. 3(*b*) are a plan view, and side view, respectively, of the latch mechanism in the first embodiment of the present invention.
Figure 3B:
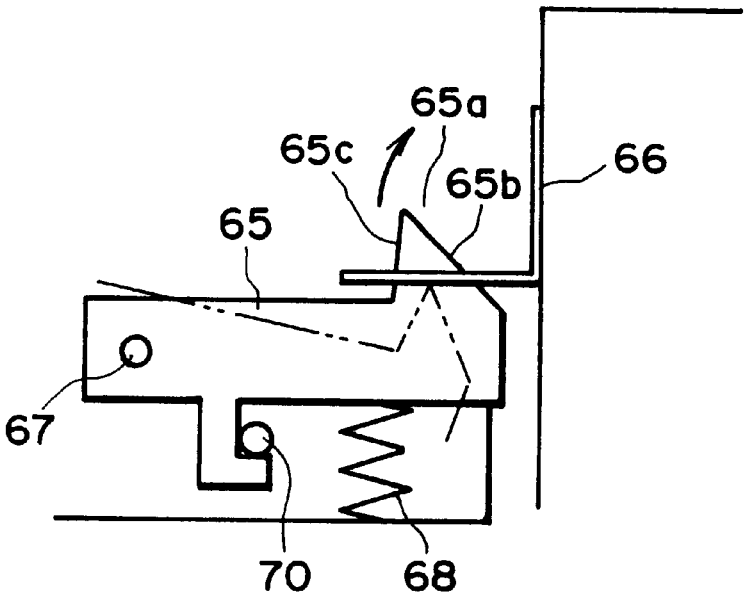

FIG. 3 depicts the latch mechanism in detail; FIG. 3(*a*) and FIG. 3(*b*) are a top view and a front view, respectively, of the latch portion.

The latch mechanism is constituted of a latch hook 65 and a locking plate 66. The base portion of the latch hook 65 is attached to a support axis 67, and its free end (right-hand end in the drawing) is provided with a claw portion 65*a*. The top surface of this claw portion 65*a* is slanted downward toward the apparatus main assembly 90A, constituting a slant surface 65*b*. The locking plate 66 is L-shaped. Its base portion is fixed to the top frame 91, and the other portion, which is perpendicular to the base portion, is provided with a locking hole 66*a*, with which the claw portion of the latch hook 65 engages, as shown in FIG. 3(*a*). Further, the latch hook 65 is always under the upward pressure generated by the elasticity of a compression spring 68, but its upward movement is regulated by a stopper 70, so that it remains substantially level. One of the surfaces of the latch hook 65, by which the latch hook 65 comes in contact with the locking plate 66, is slightly slanted toward the apparatus main assembly 90A, constituting a slightly slanted (but substantially vertical) surface 65*c*, so that, as the locking plate 66 is rotatably moved upward by the opening movement of the top frame 91, the latch hook 65 is allowed to slide out of the locking hole 66*a* of the locking plate 66.

In other words, the connecting apparatus 60, which connects the sorter 1 to the image forming apparatus 90, is constituted by the latch mechanism comprising the latch hook 65, the locking plate 66, the pivoting plate 63, and the like.

When an image forming operation and a sorting operation are normally carried out using the system constituted of the image forming apparatus 90, the sorter 1, the connecting apparatus 60, and the like, the sorter 1 is subjected to a force acting to rotate the sorter 1 about the support axis 62 in the arrow D direction (FIG. 2(*b*)), due to its own weight, but since the latching mechanism is disposed above the support axis 62, and the slightly tilted surface 65*c* of the latch hook 65 is engaged with the hole of the locking plate 66, the sorter 1 remains stationary at the operating position to allow the sheets P to be sorted and stored into the sorter 1 (FIG. 4).

Figure 5:
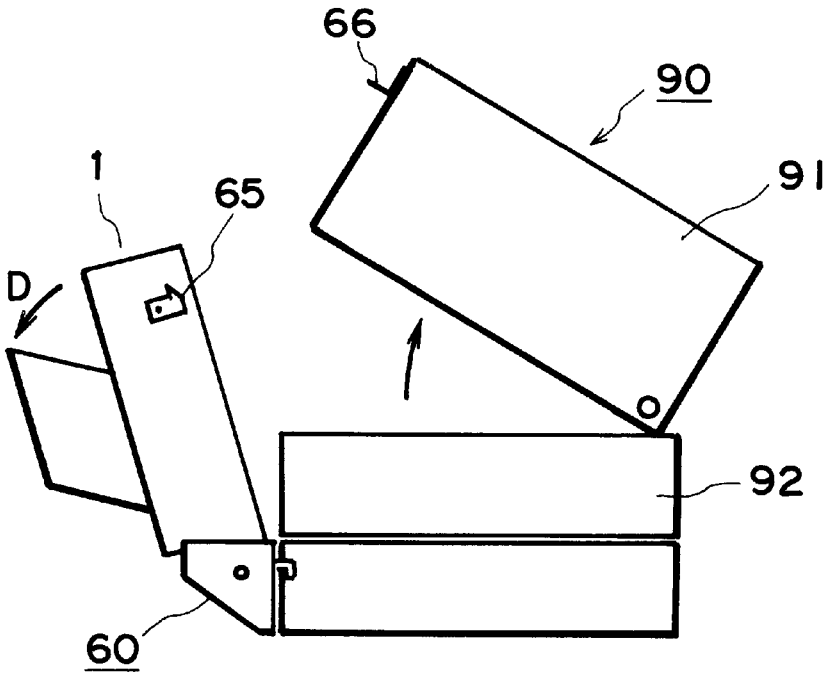
FIG. 5 depicts the top frame at the open position, and the sorter at the retracting position.

As the top frame 91 is opened upward by a user in an abnormal situation, for example, when a jam or the like, which occurs within the apparatus main assembly 90A, must be dealt with, the locking plate 66 fixed to the top frame 91 is moved upward, along with the top frame 91, being disengaged from the claw portion 65*a* (65*c*) of the latch hook 65. As a result, the sorter 1 pivots by the angle β due to its own weight, to the retracting position, at which it stops (FIG. 5). Since the pivoting angle β is set up to be smaller than the tilt angle α of the bin tray B, the sheets stored in the bin tray B do not fall off. Further, since the retracted sorter 1 remains tilted (retracted) due to its own weight while the top frame 91 is opened, operational efficiency is improved.

Figure 6:
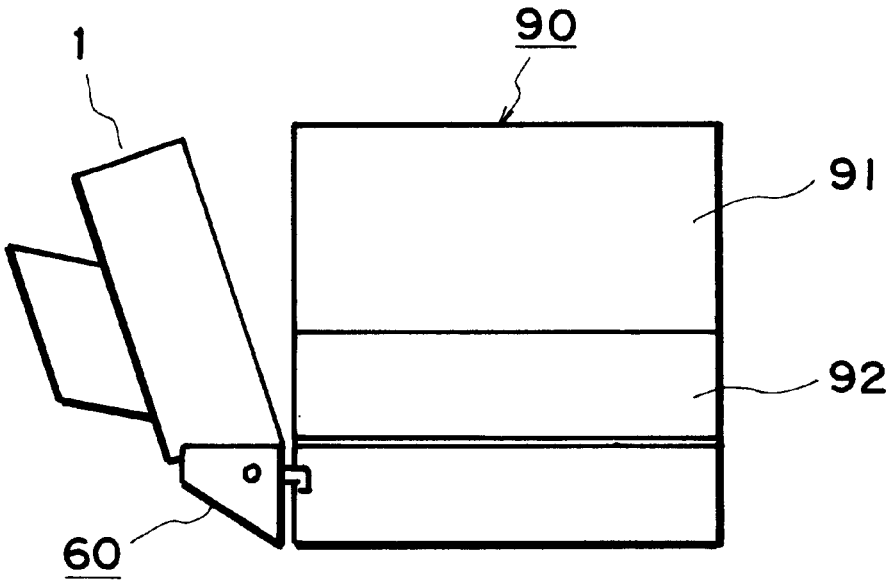
FIG. 6 depicts the top frame at the closed position, and the sorter at the operating position.

Thereafter, when the user closes down the top frame 91 from its open position after a jam or the like within the apparatus main assembly 90A is dealt with, the sorter 1 having pivoted away to the retracting position guarantees a sufficient space between itself and the image forming apparatus 90, causing no interference with the closing movement of the top frame 91. As a result, the operational properties of the top frame 91 are improved (FIG. 6).

When the sorter 1, which is at the retracting position, is pushed (pivoted) to the right to be returned toward the apparatus main assembly side after the top frame 91 is closed, the slanted surface 65*b* of the claw portion 65*a* of the latch hook 65 first comes in contact with the edge of the locking plate 66. As the sorter 1 is further closed down, the latch hook 65 rotates, compressing the spring 68, as far as the position illustrated by the two-dot line in the FIG. 3(*b*), where the claw portion 65*a* re-engages with the square hole 66*a*, locking the sorter 1 to the normal operating position.

When an attempt is made to return the sorter 1 to the operating position before the top frame 91 is closed, the latch hook 65 cannot be engaged with the locking plate 66, offering no means for holding the sorter 1 at the operating position. As a result, the sorter 1 automatically pivots away from the apparatus main assembly 90A to the retracting position, refraining from interfering with the operation to close the top frame 91. Thus, the top frame 91 can always be closed with a preferable efficiency, without the interference from the sorter 1.

The sorter 1, which was described as a sheet storing apparatus in the preceding description of the embodiment, is a sorter in which plural bin trays are vertically arranged, but the sheet storing apparatus may be an apparatus of a different type (finisher) which uses a single tray to sort sheet sets.

Further, in order to reduce the shock generated during the leftward pivoting of the sorter, an oil pressure (air) damper or the like may be provided, as well as a spring which acts to pivot the sorter leftward.

As for the latch mechanism, the latch hook and locking plate may be disposed on the apparatus main assembly, and the sorter, respectively.

Embodiment 2

In the first embodiment, the sorter 1 is enabled to move away from the image forming apparatus 90 through its vertically pivoting movement. In this embodiment, the sorter 1 is horizontally and parallelly slid away in the side-to-side direction in the drawing. This sliding movement and the related structure will be described with reference to FIGS. 7–9, in which the reference numerals identical to those in the preceding embodiment designate the same members.

Figure 7:
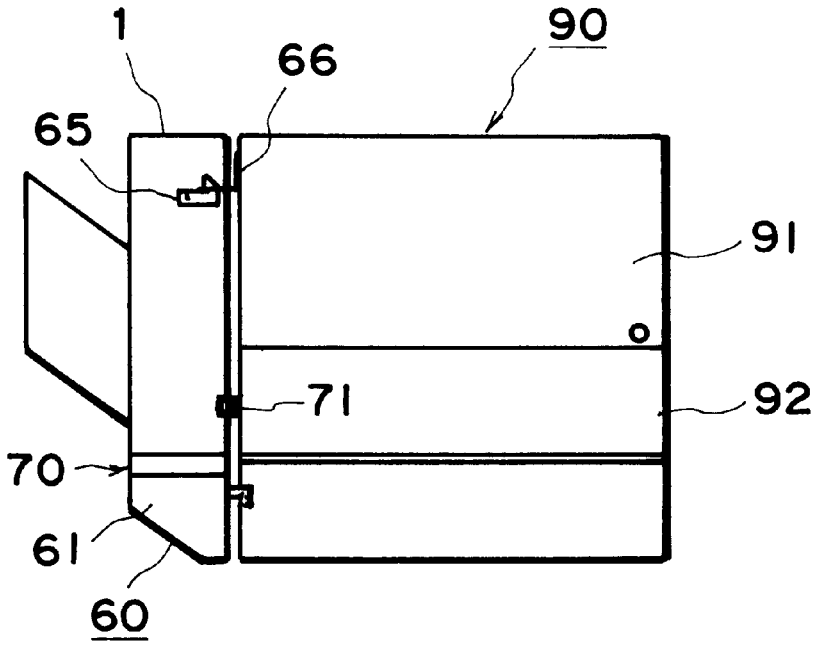
FIG. 7 is a front view depicting the connecting apparatus of the sorter, the top frame at the closed position, and the sorter at the operating position, in the second embodiment of the present invention.
Figure 8:
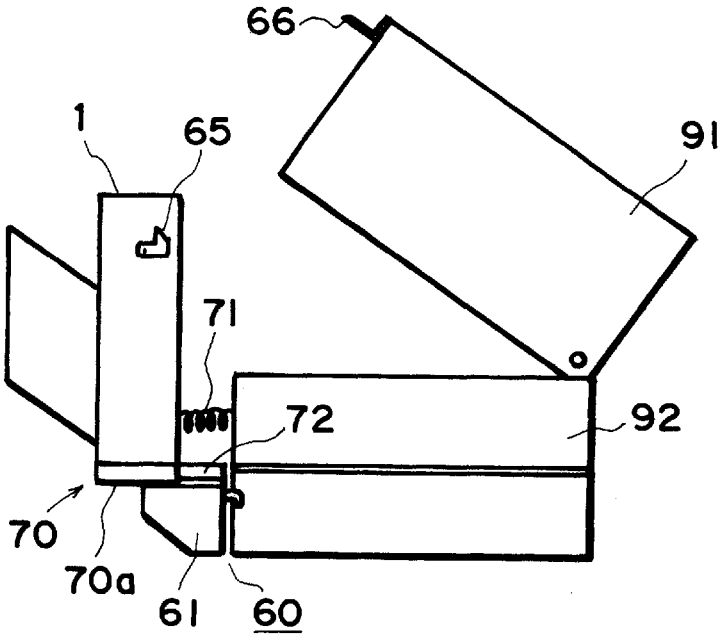
FIG. 8 depicts the top frame at the open position, and the sorter at the retracted position, in the second embodiment of the present invention.
Figure 9:
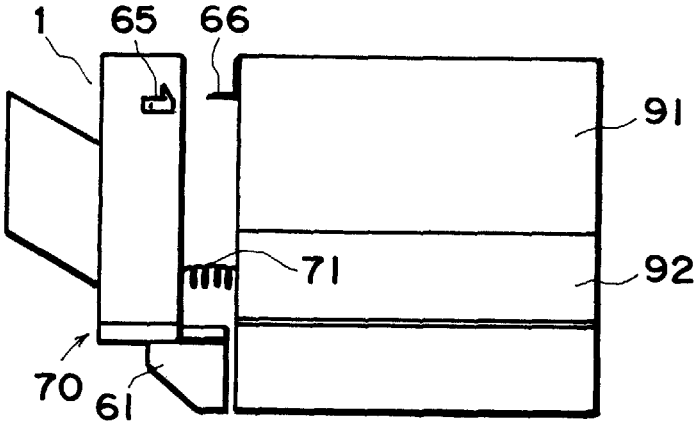
FIG. 9 depicts the top frame at the closed position, and the sorter at the retracted position, in the second embodiment of the present invention.
Figure 10:
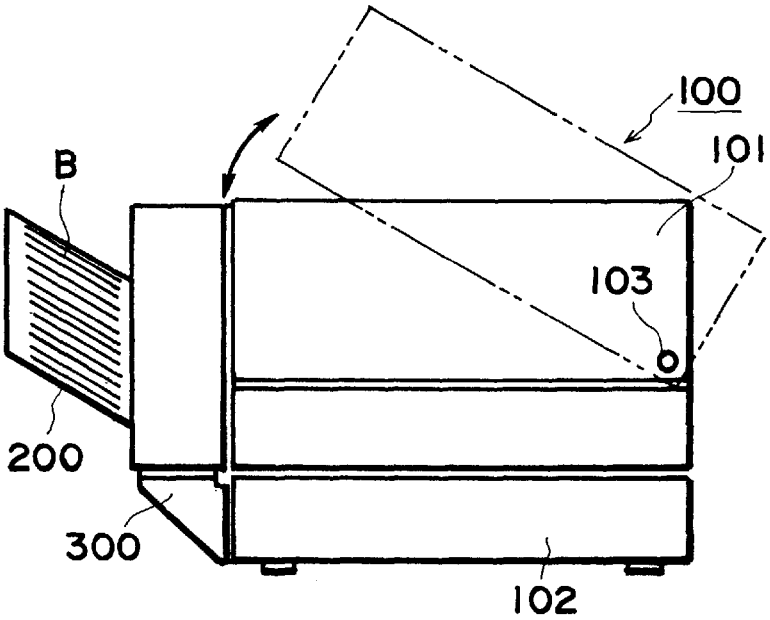
FIG. 10 PRIOR ART
FIG. 10 depicts a conventional image forming apparatus, the top frame of which is openable like an alligator jaw, a conventional sorter, and a conventional connecting apparatus.

Referring to FIGS. 7–9, the mounting plate 61 is removably attached to the bottom frame 92. A guide member 72 constituted by a slide rail, for example, is disposed on the mounting plate 61, extending in a direction perpendicular to the side wall of the apparatus main assembly 90A.

On the bottom surface of the sorter 1, a guide member 70*a* constituted by a guide rail is mounted. This guide member 70*a* engages with, and slides on, the guide member 72 disposed on the mounting plate 61. These two guide members 70*a* and 72 constitute guiding means 70, which allows the sorter 1 to be moved to, or away from, the main assembly 90A of the image forming apparatus 90.

The sorter 1 is placed under a constant pressure from a pressure generating member 71 (for example, a compression spring), which is directed so as to move the sorter 1 away from the top frame 91.

Between the sorter 1 and the apparatus main assembly 90*a*, the same latch mechanism as that in the first embodiment is disposed. This latch mechanism comprises a latch hook 65 mounted on the sorter 1, and a locking plate 66 mounted on the apparatus main assembly 90A. The guide means 70, the pressure generating means 71, the latch mechanism, and the like constitute the connecting apparatus 60 for connecting the sorter 1 to the apparatus main assembly 90A.

In this embodiment, when the top frame 91 is opened by a user in order to deal with a jam, which is caused within the apparatus main assembly 90A by the sheet P, in order to inspect and maintain the apparatus, or in order to carry out like operations, the locking plate 66, in engagement with the latch hook 65 is released as illustrated in FIG. 8. Consequently, the sorter 1, which is under the constant pressure from the pressure generating member 71, slides in a direction to move away from the apparatus main assembly 90A; in other words, it moves from the operating position, illustrated in FIG. 7, to the retracting position illustrated in FIG. 8. As it arrives at the position illustrated in FIG. 8, it is retained there by a stopper.

Thus, also in this embodiment, when the top frame 91 is closed down after a jam or the like is dealt with, a sufficient space is reliably provided between the top frame 91 and sorter 1 (FIG. 9); therefore, the top frame 91 can be smoothly closed down without being subjected to any interference, improving the operational properties of the top frame 91, and as a result, improving the operational properties of the image forming apparatus 90 in dealing with a jam or the like anomaly. After the jam or the like is dealt with, the sorter 1 is moved to the right to be reconnected to the image forming apparatus 90 as shown in FIG. 7.

When an attempt is made to return the sorter 1 to the operating position before the top frame 91 is closed down, the latch mechanism components 65 and 66 cannot engage with each other; therefore, the sorter 1, which is under constant pressure from the pressure generating member 71, is moved back to the retracting position. As a result, the occurrence of a condition, which might hamper the operational properties of the top frame 91 in closing it, is prevented.

Further, in order to reduce the impact caused by the leftward slide of the sorter 1, an oil pressure (air) dumper or the like may be provided. Also, the latch hook and locking plate may be mounted on the apparatus main assembly, and the sorter, respectively.

While the invention has been described with reference to the structures disclosed herein, it is not confined to the details set forth, and this application is intended to cover such modifications or changes as may come within the purposes of the improvements or the scope of the following claims.

What is claimed is:

1. A sheet processing apparatus comprising:

a main assembly having an upper frame and a lower frame, said upper frame being openable substantially along a longitudinal direction to provide a space between the upper and lower frames;

sheet accommodating means having at least one sheet receiving tray for receiving a sheet discharged from the main assembly, said sheet accommodating means being movable between an operative position for accommodating the sheet and a retracted position away from said main assembly;

engaging means for engaging said sheet accommodating means with said main assembly and releasing the engagement of said sheet accommodating means and said main assembly, wherein said engaging means releases its engagement in interrelation with an opening operation of said upper frame; and supporting means for supporting said sheet accommodating means to automatically move to a retracted position when said engaging means releases its engagement of said main assembly and said sheet accommodating means.

2. An apparatus according to claim 1, wherein said engaging means has latching means not engageable when said upper frame is open.

3. An apparatus according to claim 1, wherein movement of said sheet accommodating means is a rotational movement about an axis.

4. An apparatus according to claim 3, wherein said sheet accommodating means rotates by its weight upon disengagement.

5. An apparatus according to claim 3, wherein said upper frame is rotatable relative to said lower frame.

6. An apparatus according to claim 5, wherein said main assembly is an image forming apparatus, and said sheet accommodating means is a sorter.

7. An apparatus according to claim 3, wherein said sheet accommodating means is a sorter.

8. An apparatus according to claim 7, wherein said sorter includes a plurality of bin trays arranged substantially vertically, wherein said plurality of bin trays is higher at its downstream side than its upstream side with respect to a movement direction of discharge of the sheet, and wherein said sorter is rotatable within a limit of maintaining the downstream portion of said plurality of bin trays higher than the upstream portion thereof or maintaining said sorter in a substantially horizontal state.

9. An apparatus according to claim 8, wherein an inclination angle of said sorter when it is at the retracted position is smaller than the inclination angle of the bin tray when the sorter is in the operative position.

10. An apparatus according to claim 1, wherein movement of said sheet accommodating means is a sliding movement.

11. An apparatus according to claim 10, wherein said supporting means comprises elastic means for sliding said sheet accommodating means upon disengagement.

12. An apparatus according to claim 10, wherein said upper frame is rotatable relative to said lower frame.

13. An apparatus according to claim 12, wherein said main assembly is an image forming apparatus, and said sheet accommodating means is a sorter.

14. An apparatus according to claim 1, further comprising spring means for biasing said sheet accommodating means to move away from said main assembly.

15. An apparatus according to claim 1, wherein said movement away from said main assembly is provided by the weight of said sheet accommodating means.

16. An apparatus according to claim 1, wherein said main assembly is an image forming apparatus, and said sheet accommodating means is sorter connected with said image forming apparatus.

17. A sheet processing apparatus comprising:

a main assembly having an upper frame and a lower frame, said upper frame being openable substantially along a longitudinal direction to provide a space between the upper and lower frames;

sheet accommodating means having at least one sheet receiving tray for receiving a sheet discharged from the main assembly, said sheet accommodating means being movable between an operative position for accommodating the sheet and a retracted position away from said main assembly;

engaging means for engaging said sheet accommodating means with said main assembly and releasing the engagement of said sheet accommodating means and said main assembly, wherein said engaging means releases the engagement in interrelation with an opening operation of said upper frame; and supporting means, wherein said sheet accommodating means is supported by said supporting means such that when the engagement is released, said sheet accommodating means is automatically moved to the retracted position.

18. An apparatus according to claim 17, wherein said supporting means supports said sheet accommodating means for rotation to the retracted position by the weight thereof when the engagement of said engaging means is released.

19. An apparatus according to claim 17, wherein said supporting means comprises elastic means for moving said sheet accommodating means to the retracted position when the engagement of said engaging means is released.

20. An apparatus according to claim 17, wherein said engaging means is not engageable when said sheet accommodating means is at the operative position, and said upper frame is at an open position.

21. An apparatus according to any one of claims 1, 4, 6, 9, 13, 16, or 20, wherein said engaging means comprises a locking plate in said main assembly and a swingable latch hook in said sheet accommodating means and said locking plate having a locking hole, said latch hook having a claw portion engageable with said locking hole and being urged by an elastic means in a direction for engagement between the claw portion and said locking hole, and wherein said sheet accommodating means is retained at the operative position by engagement between a surface of the claw portion and a surface of said locking hole, and the surface of said claw portion permits the latch hook to slide out of said locking hole of said locking plate as said locking plate is rotatively moved upward by the opening movement of said upper frame.

22. An apparatus according to any one of claims 1, 4, 6, 9, 13, 16, or 20, wherein said engaging means comprises a locking plate in said main assembly and a latch hook in said sheet accommodating means and said locking plate having a locking hole, said latch hook having a claw portion engageable with said locking hole, and wherein said sheet accommodating means is retained at the operative position by engagement between a surface of the claw portion and a surface of said locking hole, and the surface of said claw portion permits said latch hook to slide out of said locking hole of said locking plate as said locking plate is rotatively moved upward by the opening movement of said upper frame.

* * * * *

UNITED STATES PATENT AND TRADEMARK OFFICE

CERTIFICATE OF CORRECTION

PATENT NO. : 6,003,865

DATED : December 21, 2000

INVENTOR(S) : KENICHI HAYASHI

It is certified that error appears in the above-identified patent and that said Letters Patent is hereby corrected as shown below:

Title page, item

[56] REFERENCES CITED:

Foreign Patent Documents

"0191374" should read --62-191374--.

"0203168" should read --1-203168--.

COLUMN 4:

Line 61, "bray" should read --tray--.

Line 62, "A reference" should read --Reference--.

COLUMN 8:

Line 31, "dumper" should read --damper--.

Signed and Sealed this

First Day of May, 2001

Nicholas P. Godici

*Attest:*

NICHOLAS P. GODICI

*Attesting Officer*

*Acting Director of the United States Patent and Trademark Office*